US011725820B1

(12) United States Patent
Stuttaford et al.

(10) Patent No.: US 11,725,820 B1
(45) Date of Patent: Aug. 15, 2023

(54) HALO RING FUEL INJECTOR FOR A GAS TURBINE ENGINE

(71) Applicant: Thomassen Energy B.V., Rheden (NL)

(72) Inventors: Peter Stuttaford, Rheden (NL); Matthijs Rijkmans, Rheden (NL); Jacobus Nicolaas Adrianus Koomen, Rheden (NL); Tim Dammers, Rheden (NL); Diethard Jansen, Rheden (NL)

(73) Assignee: Thomassen Energy B.V., Rheden (NL)

( * ) Notice: Subject to any disclaimer, the term of this patent is extended or adjusted under 35 U.S.C. 154(b) by 0 days.

(21) Appl. No.: 17/834,337

(22) Filed: Jun. 7, 2022

(51) Int. Cl.
*F23R 3/28* (2006.01)
*F23R 3/00* (2006.01)
*F23R 3/60* (2006.01)

(52) U.S. Cl.
CPC ..... *F23R 3/283* (2013.01); *F23R 3/286* (2013.01); *F23R 3/002* (2013.01); *F23R 3/60* (2013.01)

(58) Field of Classification Search
CPC ..... F23R 3/283; F23R 3/286; F23R 3/60
See application file for complete search history.

(56) References Cited

U.S. PATENT DOCUMENTS 5,121,608 A * 6/1992 Willis ..... F23D 11/36 60/737
6,189,314 B1 * 2/2001 Yamamoto ..... F23R 3/30 60/737
7,137,256 B1 * 11/2006 Stuttaford ..... F23R 3/343 60/773
7,237,384 B2 * 7/2007 Stuttaford ..... F23R 3/14 60/737
8,991,187 B2 * 3/2015 Hughes ..... F23R 3/36 60/737
9,228,499 B2 * 1/2016 Stryapunin ..... F23R 3/346
10,378,456 B2 * 8/2019 Stuttaford ..... F02C 9/28
10,718,525 B2 * 7/2020 Jorgensen ..... F23R 3/14
10,739,007 B2 * 8/2020 Cires ..... F23R 3/60
11,149,948 B2 * 10/2021 Stevens ..... F23R 3/343
2004/0226300 A1 * 11/2004 Stuttaford ..... F23R 3/286 60/737
2006/0162337 A1 * 7/2006 Stuttaford ..... F23R 3/286 60/776
2006/0260316 A1 * 11/2006 Stuttaford ..... F23D 14/82 60/737
2011/0067402 A1 * 3/2011 Wiebe ..... F23R 3/46 60/740

(Continued)

*Primary Examiner* — William H Rodriguez
(74) *Attorney, Agent, or Firm* — Hovey Williams LLP

(57) ABSTRACT

A fuel injector assembly for a combustor of a gas turbine engine includes an annular body defining a hollow interior space, first and second openings to the interior space, and a chamber defining a fluid manifold. The first and second openings are respectively proximate opposite first and second ends of the annular body. The first end is upstream of the second end. The fuel injector assembly includes an annular fuel nozzle positioned in the interior space and spaced from the annular body. The annular fuel nozzle includes a plurality of fuel injection ports configured for injecting a fuel into the combustor. The fuel injector assembly also includes one or more fuel supply struts coupled to the annular fuel nozzle and the annular body. The fuel supply struts are coupled in fluid communication with the fluid manifold and the annular fuel nozzle for channeling a fuel therethrough.

12 Claims, 12 Drawing Sheets

(56) References Cited

U.S. PATENT DOCUMENTS

| | | | | |
|---|---|---|---|---|
| 2011/0239653 | A1* | 10/2011 | Valeev | F23R 3/34 60/740 |
| 2016/0084169 | A1* | 3/2016 | Stuttaford | F23R 3/343 60/776 |
| 2019/0346142 | A1* | 11/2019 | Cires | F23R 3/343 |

* cited by examiner

HALO RING FUEL INJECTOR FOR A GAS TURBINE ENGINE

BACKGROUND

The present invention relates specifically to gas turbine engines and to combustion systems in general, and more particularly, to a halo ring fuel injector for use in combustion systems of gas turbine engines.

The combustion of a wide range of fuels including (but not limited to) blends of hydrogen in conventional combustion systems of gas turbine engines can cause several technical problems. For example, one technical issue is flashback and flame anchoring at or close to the main fuel injector of the combustion system. Flashback can occur when fuel is contained in the boundary layers of the combustion air stream. Another technical issue is the formation of oxides of nitrogen (NOx) and carbon monoxide (CO). The technical issues are caused at least partly on account of the high flame velocity and short ignition delay times because of the use of highly reactive fuel constituents like hydrogen in the fuel gas mixture. Low pollutant formation requires an optimal air-fuel mixing profile while preventing excessive thermo-acoustics.

BRIEF DESCRIPTION

This brief description is provided to introduce a selection of concepts in a simplified form that are further described in the detailed description below. This brief description is not intended to identify key features or essential features of the claimed subject matter, nor is it intended to be used to limit the scope of the claimed subject matter. Other aspects and advantages of the present disclosure will be apparent from the following detailed description of the embodiments and the accompanying figures.

In one aspect, a fuel injector assembly is provided. The fuel injector assembly includes an annular body defining a hollow interior space, first and second openings to the interior space, and a chamber defining a fluid manifold. The first and second openings are respectively proximate opposite first and second ends of the annular body. The first end is upstream of the second end. The fuel injector assembly also includes an annular fuel nozzle positioned in the interior space. The annular fuel nozzle is spaced from the annular body. The annular fuel nozzle includes a plurality of fuel injection ports. Furthermore, the annular fuel nozzle includes one or more fuel supply struts coupled to the annular fuel nozzle and the annular body. The one or more fuel supply struts are coupled in fluid communication with the fluid manifold and the annular fuel nozzle.

In another aspect, a combustor is provided. The combustor includes a cylindrical combustion liner having an inlet end, an outlet end, and a central axis. The combustion liner defines a combustion chamber. The combustor also includes a fuel injector assembly positioned radially outward of the cylindrical combustion liner relative to the central axis. The fuel injector assembly includes an annular body defining a hollow interior space, first and second openings to the interior space, and a chamber defining a fluid manifold. The first and second openings are respectively proximate opposite first and second ends of the annular body. The first end is upstream of the second end. The fuel injector assembly also includes an annular fuel nozzle positioned in the interior space. The annular fuel nozzle is spaced from the annular body. The annular fuel nozzle includes a plurality of fuel injection ports. Furthermore, the annular fuel nozzle includes one or more fuel supply struts coupled to the annular fuel nozzle and the annular body. The one or more fuel supply struts are coupled in fluid communication with the fluid manifold and the annular fuel nozzle.

A variety of additional aspects will be set forth in the detailed description that follows. These aspects can relate to individual features and to combinations of features. Advantages of these and other aspects will become more apparent to those skilled in the art from the following description of the exemplary embodiments which have been shown and described by way of illustration. As will be realized, the present aspects described herein may be capable of other and different aspects, and their details are capable of modification in various respects. Accordingly, the figures and description are to be regarded as illustrative in nature and not as restrictive.

BRIEF DESCRIPTION OF THE DRAWINGS

The figures described below depict various aspects of systems and methods disclosed therein. It should be understood that each figure depicts an embodiment of a particular aspect of the disclosed systems and methods, and that each of the figures is intended to accord with a possible embodiment thereof. Further, wherever possible, the following description refers to the reference numerals included in the following figures, in which features depicted in multiple figures are designated with consistent reference numerals.

Unless otherwise indicated, the figures provided herein are meant to illustrate features of embodiments of this disclosure. These features are believed to be applicable in a wide variety of systems comprising one or more embodiments of this disclosure. As such, the figures are not meant to include all conventional features known by those of ordinary skill in the art to be required for the practice of the embodiments disclosed herein.

DETAILED DESCRIPTION

The following detailed description of embodiments of the disclosure references the accompanying figures. The embodiments are intended to describe aspects of the disclosure in sufficient detail to enable those with ordinary skill in the art to practice the disclosure. The embodiments of the disclosure are illustrated by way of example and not by way of limitation. Other embodiments may be utilized, and changes may be made without departing from the scope of the claims. The following description is, therefore, not limiting. The scope of the present disclosure is defined only by the appended claims, along with the full scope of equivalents to which such claims are entitled.

Broadly, a fuel injector for a gas turbine engine combustor includes a halo ring nozzle that "floats" in the free air stream of an air intake channel. The nozzle injects the fuel into the middle of the air stream, thereby reducing or eliminating fuel in the boundary layers of the air stream. Further, the halo ring nozzle injects the air at an angle relative to the primary direction of the air stream, which facilitates improving the mixing of the fuel and the air. A thorough mixture of the air and fuel facilitates reducing NOx and CO emissions of the gas turbine engine. In certain embodiments, the fuel injector further includes support struts configured to induce swirl to at least of portion of the air stream, thereby further promoting mixing of the fuel and air.

Figure 1:
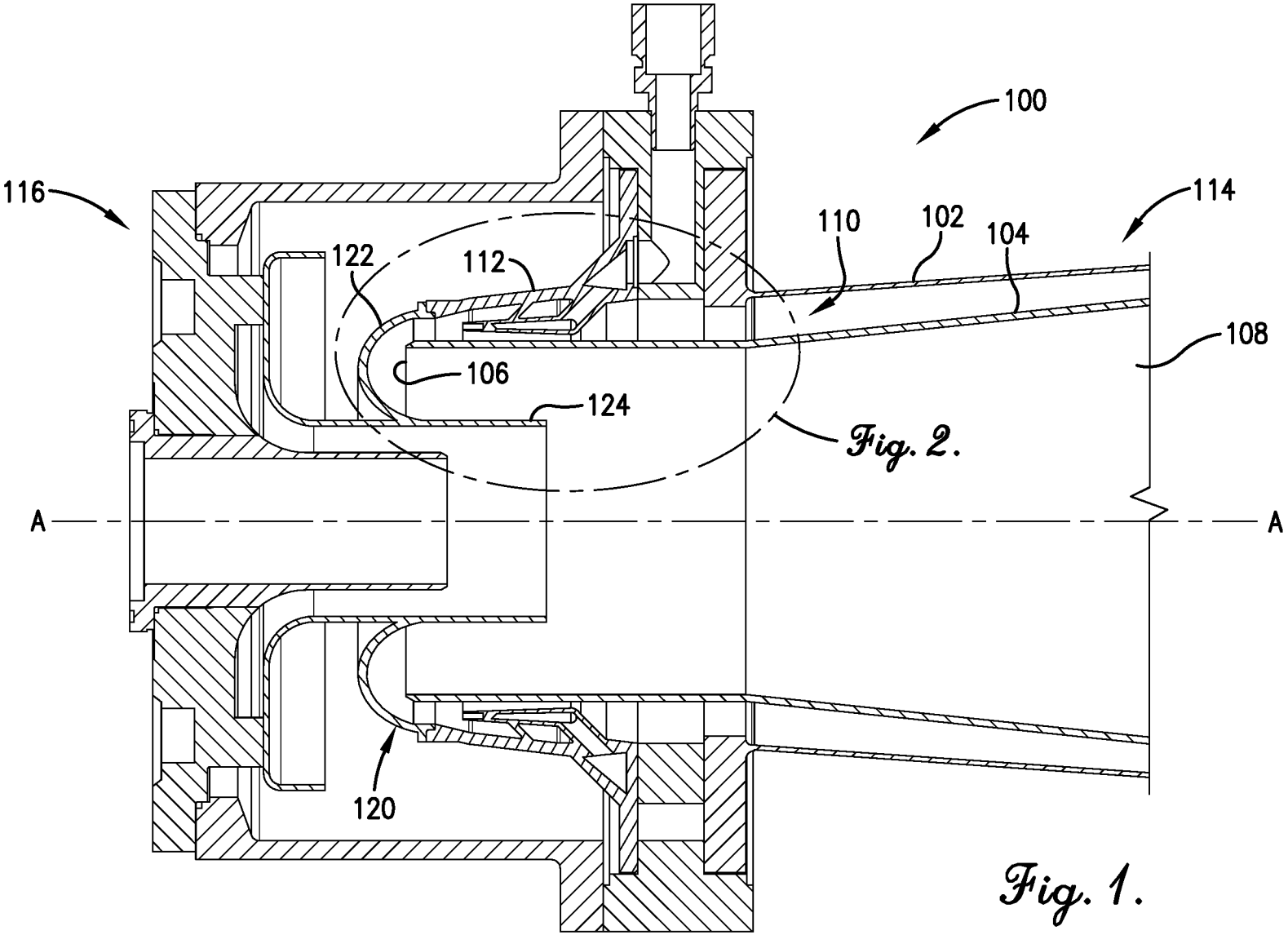
FIG. 1 is a side view of a combustor for a gas turbine engine and taken in vertical section, in accordance with one or more embodiments of the present invention.

Turning now to the drawings in greater detail and initially to FIG. 1, a combustor intended for use in a gas turbine engine (not shown) is designated generally by the numeral 100. In the exemplary embodiment, the combustor 100 extends longitudinally along a central axis "A." The combustor 100 includes a generally cylindrical flow sleeve 102. The flow sleeve 102 surrounds a generally cylindrical and co-axial combustion liner 104, defining at least a portion of an axially extending annular passageway 110 therebetween. The combustion liner 104 has an inlet end 106 and an outlet end 108, defining a combustion chamber therebetween. The flow sleeve 102 is configured to channel an air stream of compressed air through the passageway 110, along an outer surface of the combustion liner 104.

Figure 2:
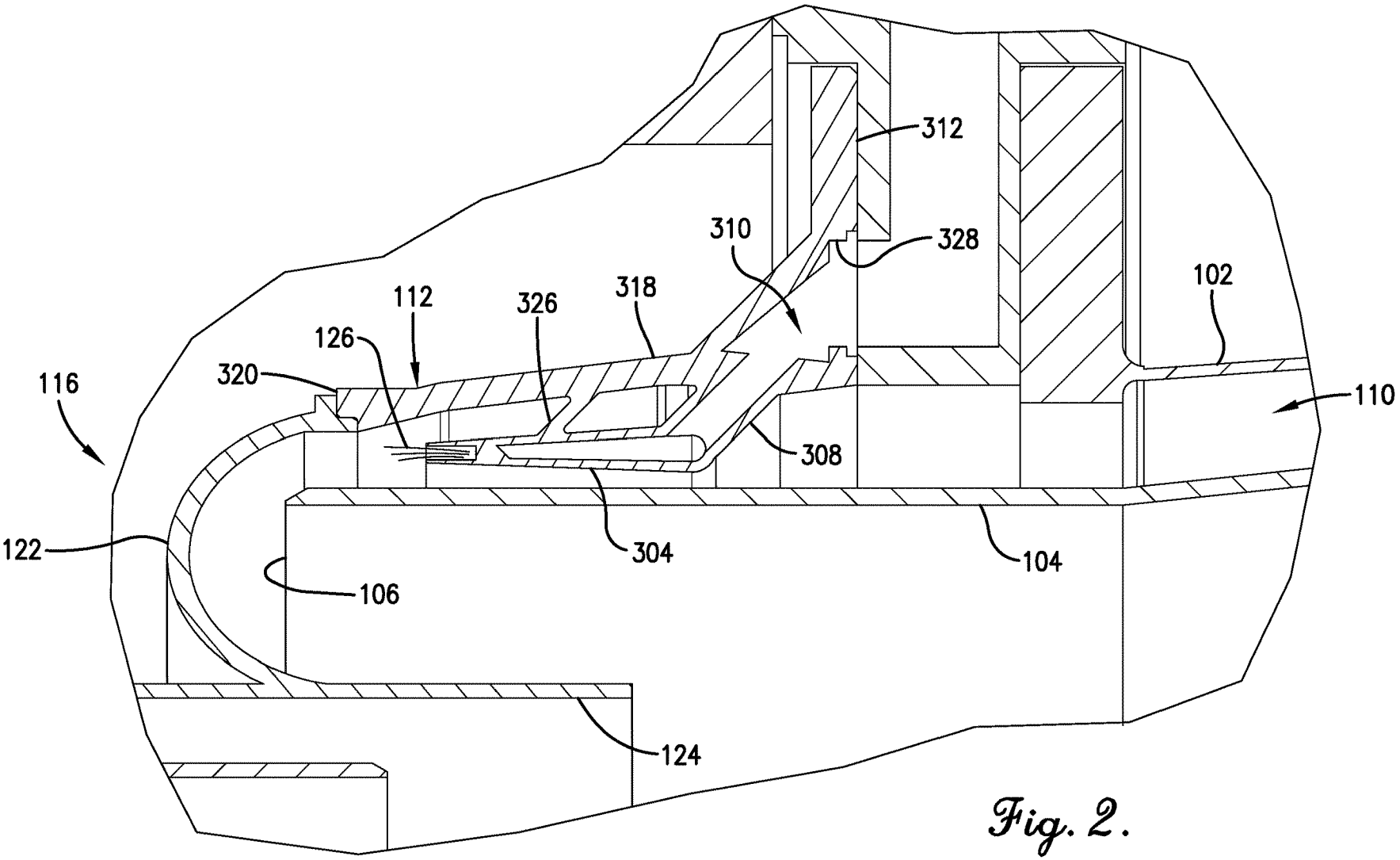
FIG. 2 is an enlarged side sectional view of a portion of the combustor of FIG. 1 and depicting a halo ring fuel injector in accordance with an embodiment of the present invention.

The combustor 100 includes a halo ring fuel injector assembly 112 positioned radially outward of the combustion liner 104. The halo ring fuel injector 112 is located proximate a downstream end of the flow sleeve 102. As shown in FIG. 2, the halo ring fuel injector 112 channels a regulated amount of fuel 126 into the air stream to provide a fuel-air mixture for the combustor 100. In particular, the halo ring fuel injector 112 receives compressed air from a compressor of the gas turbine engine (not shown) via the passageway 110 from an upstream end 114 to a downstream end 116 of the combustor 100.

The compressed air passes through a plurality of perforations (not shown) in the flow sleeve 102, enters the passageway 110 (i.e., the hollow annular space between the flow sleeve 102 and combustion liner 104), and flows downstream toward the downstream end 116. Consequently, the compressed air operates, in part, to cool the combustor 100 prior to mixing with the fuel 126 for combustion. The compressed air flows into the halo ring fuel injector 112 for mixing with the fuel 126. The fuel 126 injected by the halo ring fuel injector 112 mixes with the compressed air and continues to travel in a forward direction towards the downstream end 116, where the fuel/air mixture then reverses direction and enters the combustion liner 104, wherein combustion of the mixture occurs. The air-fuel mixture combusts downstream of the halo ring fuel injector 112 within the combustor 100. Mixing of the air and fuel streams may depend on properties of each stream, such as fuel heating value, flow rates, and temperature. As discussed in detail herein, the halo ring fuel injector 112 includes various features to prevent flashback and/or flame anchoring at or near the halo ring fuel injector 112, and to reduce or eliminate boundary layers of the air stream from containing fuel, such as the fuel 126.

In the example embodiment, the combustor 100 includes a combustor dome assembly 120 that encompasses the inlet end 106 of the combustion liner 104. The combustor dome assembly 120 includes a generally hemispherical-shaped wall 122 that extends from proximate the halo ring fuel injector 112 to a location a distance into the inlet end 106 of the combustion liner 104. That is, the dome assembly 120 turns through the hemispherical-shaped wall 122 and extends a distance into the combustion liner 104 through a dome assembly inner wall 124.

Figure 3:
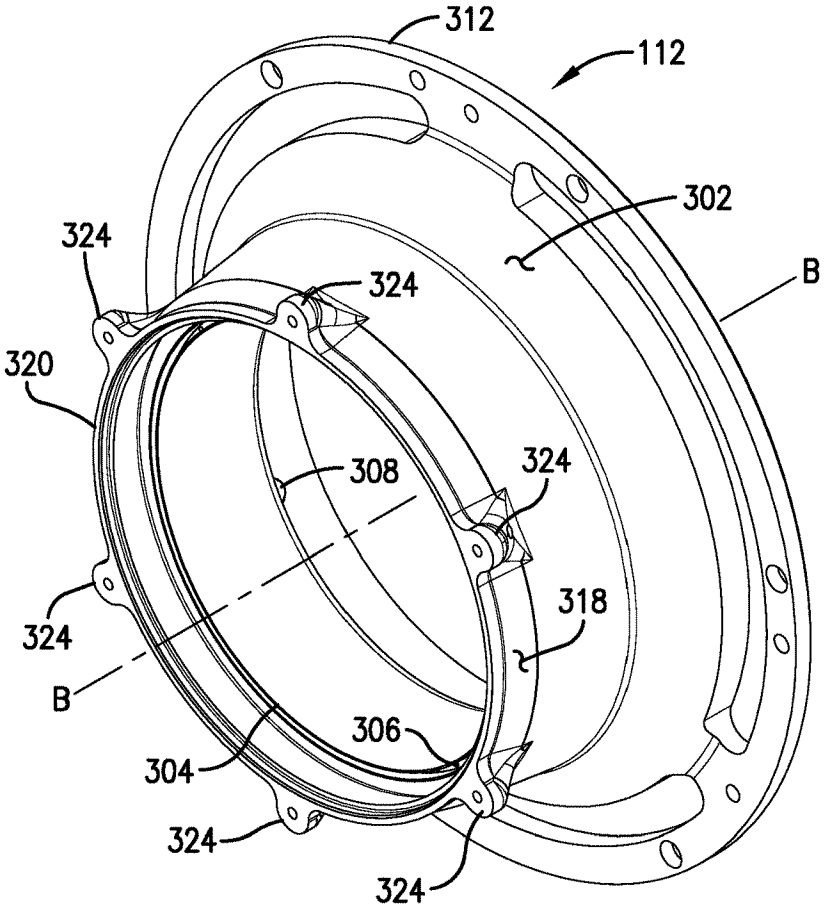
FIG. 3 is front perspective of the embodiment of the halo ring fuel injector of the combustor shown in FIG. 1.

Referring to FIG. 2, the injected fuel 126, which may be a fuel mixture, may be any fuel composition, such as natural gas, hydrogen, synthetic gas (or Syngas), and the like, for example. In the example embodiment, the fuel 126 is injected into the air stream via one or more halo ring fuel injectors 112 positioned in the air stream, each halo ring fuel injector 112 having a plurality of angled fuel injection ports 306 (shown in FIG. 3) defined in a generally airfoil-shaped annular fuel nozzle 304. The annular fuel nozzle 304 is supported by a plurality of fuel supply struts 308, each of which is coupled in fluid communication to a chamber defining a common annular fluid manifold 310.

Various detail views of the exemplary halo ring fuel injector 112 are shown in FIGS. 3-9. In certain implementations, the halo ring fuel injector 112 is a unitary component that may be manufactured using various techniques, including, without limitation, additive manufacturing. Additive manufacturing is a technology that enables the "3D-printing" of components of various materials including metals, ceramics, and plastics. In additive manufacturing, a part is built in a layer-by-layer manner, for example, by leveling metal powder and selectively melting or fusing the powder within a layer using a high-power laser or electron beam. After each layer, more powder is added and the laser patterns the next layer, simultaneously melting or fusing it to the prior layers to fabricate a complete component. In one embodiment, the halo ring fuel injector 112 may be fabricated using a direct metal laser melting (DMLM) process. The geometries of the halo ring fuel injector 112 are difficult to form using conventional casting technologies, thus fabrication of the halo ring fuel injector 112 using a DMLM process or an electron-beam melting process may be advantageous, for example, in the exemplary embodiment. It is contemplated, however, that any manufacturing process that enables the halo ring fuel injector 112 to be fabricated as described herein, may be used. Further, it is noted that the halo ring fuel injector 112 may require post-processing to provide desired structural characteristics.

Figure 6:
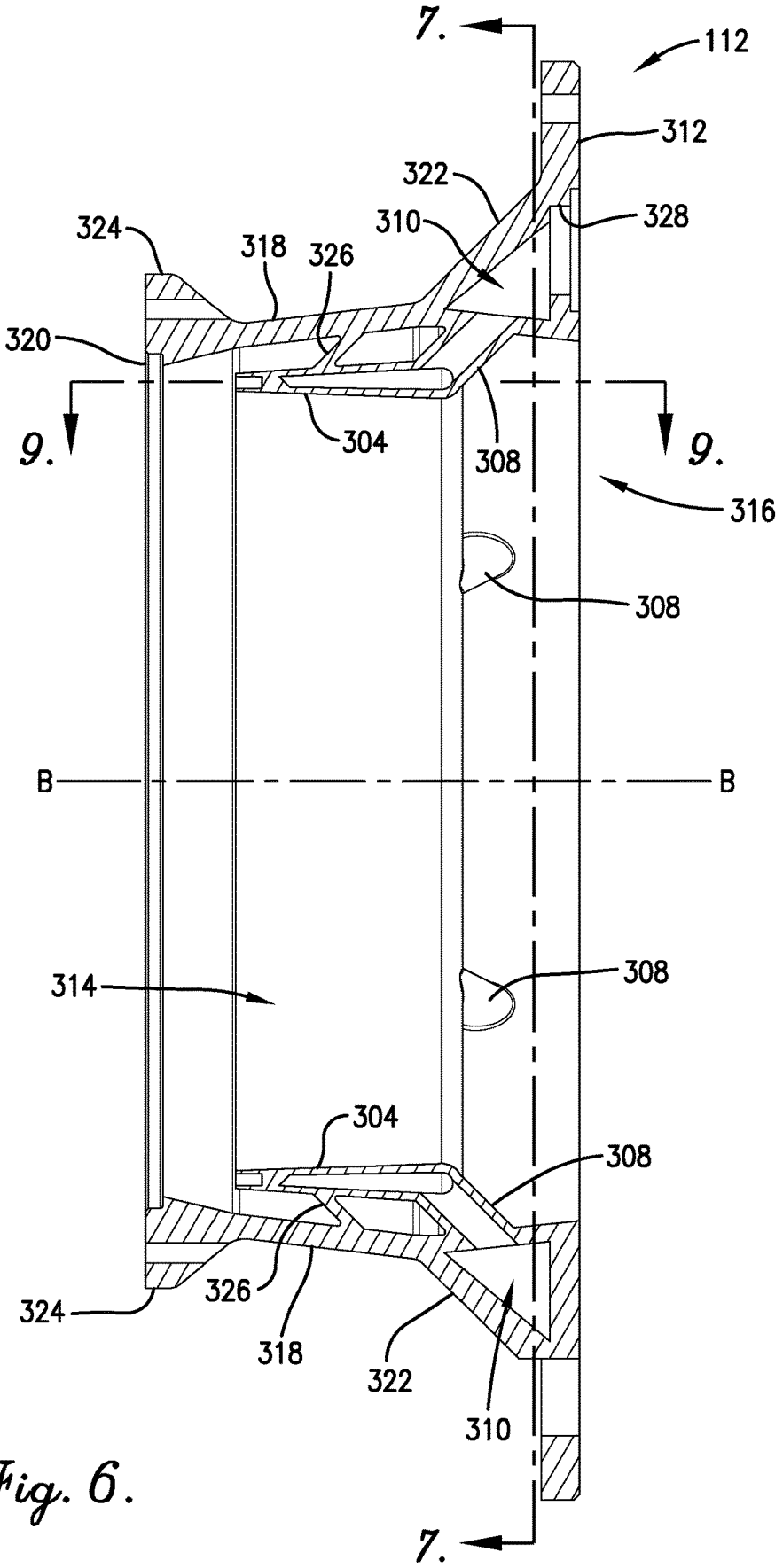
FIG. 6 is a side view of the embodiment of the halo ring fuel injector shown in FIGS. 3-5, taken in vertical section along line 6-6 in FIG. 5 in the direction of the arrows.
Figure 8:
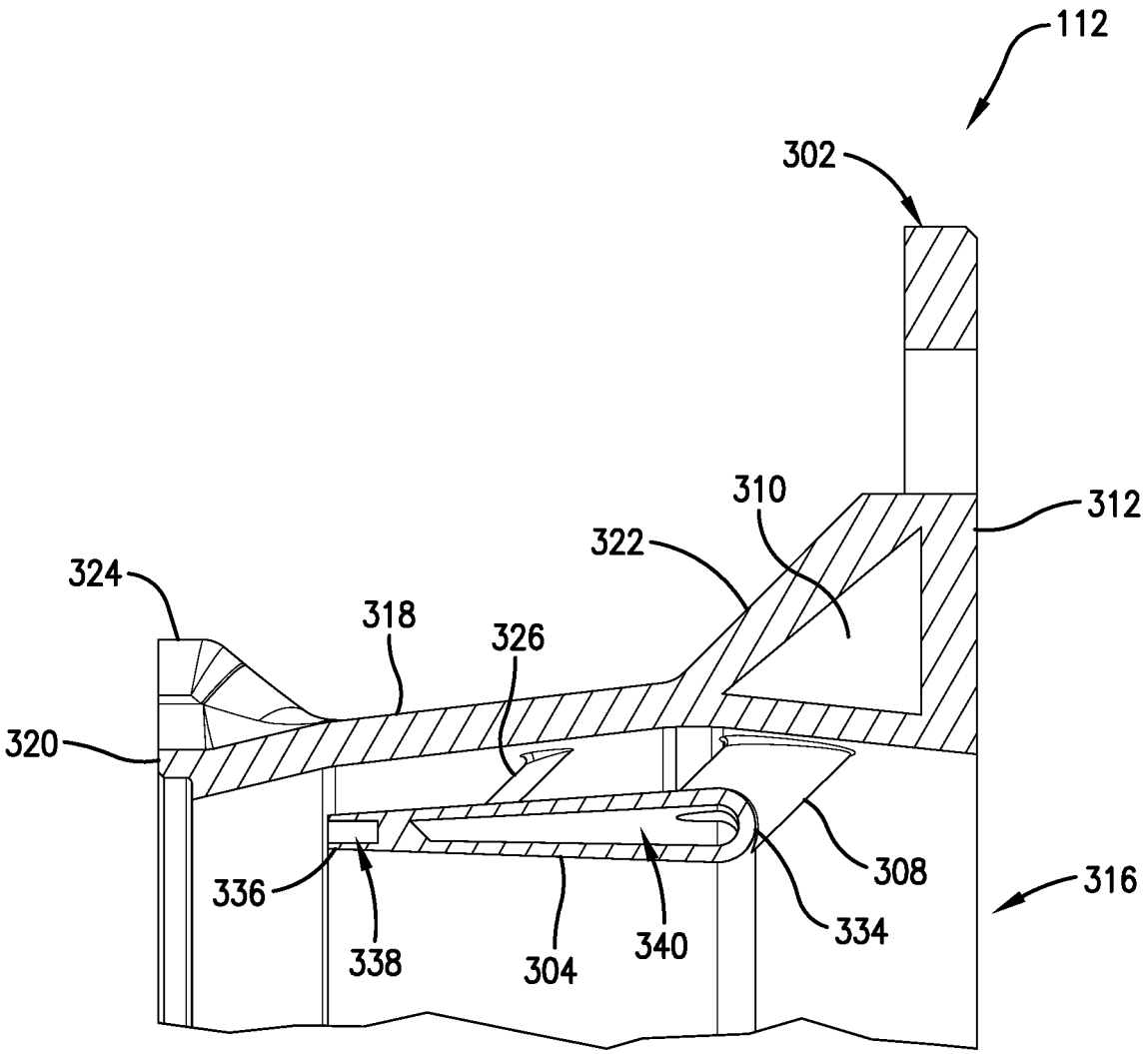
FIG. 8 is a partial side view of the embodiment of the halo ring fuel injector, taken in section along line 8-8 in FIG. 5 in the direction of the arrows and showing an airfoil-shaped nozzle.

In the exemplary embodiment, the halo ring fuel injector 112 is formed generally symmetrically about a central axis "B." The halo ring fuel injector 112 includes a generally cylindrical body 302. The body 302 is formed in a generally frustoconical shape, having a hollow interior space 314 defined therein. An upstream flange 312 of the body 302 defines an opening 316 to the interior space 314. A cylindrical downstream wall 318 extends generally axially downstream from the upstream flange 312 towards a downstream rim 320 of the body 302, wherein the downstream rim 320 defines a second opening to the interior space 314. A tapered wall 322 extends from a portion of the upstream flange 312 downstream at an inward angle to the downstream wall 318 of the body 302. The annular manifold 310 is triangular in section (as depicted in FIGS. 6 and 8) and is generally defined between the upstream flange 312, downstream wall 318, and the tapered wall 322. Proximate the downstream rim 320, the body 302 includes a plurality of mounting tabs 324.

Figure 5:
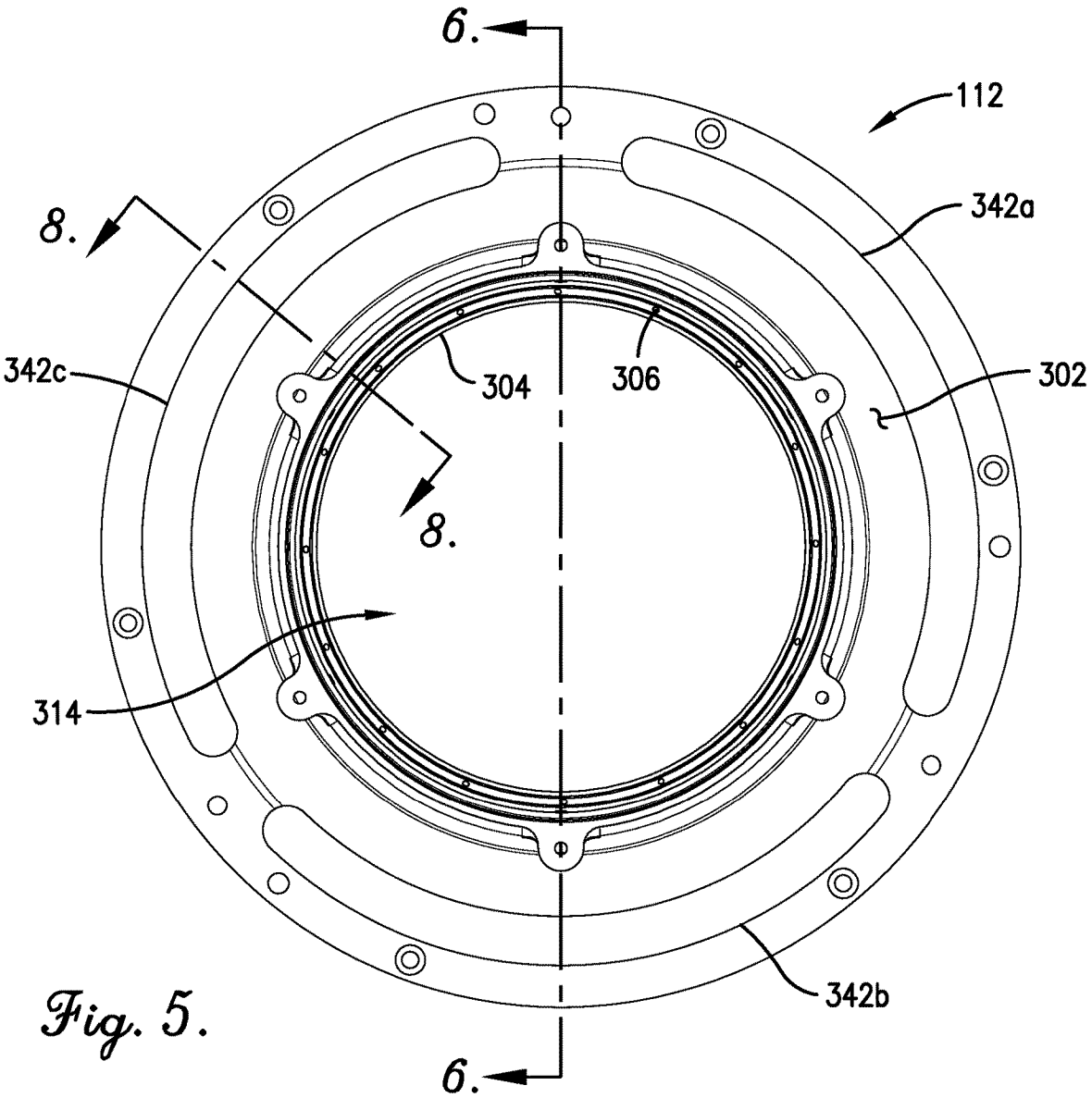
FIG. 5 is a front elevation view of the embodiment of the halo ring fuel injector shown in FIG. 3.

Referring to FIG. 5, the example halo ring fuel injector 112 includes a plurality of arcuate channels 342*a*, 342*b*, and 342*c* defined in the upstream flange 312 of the body 302. The arcuate channels 342*a*, 342*b*, and 342*c* are generally concentric with the central axis "B" of the halo ring fuel injector 112. The arcuate channels 342*a*, 342*b*, and 342*c* are configured to allow air to pass therethrough, for example, to supply an air stream to a pilot fuel nozzle (not shown) of the combustor 100. The arcuate channels 342*a*, 342*b*, and 342*c* extend arcuately at an angle in the range between and including about ninety degrees (90°) and about one hundred and ten degrees (110°).

As described above, the example halo ring fuel injector 112 includes the annular fuel nozzle 304. The annular fuel nozzle 304 is spaced inward of the downstream wall 318 a predefined distance. As depicted in FIG. 2, the annular fuel nozzle 304 is generally positioned in the air stream such that it is spaced from the combustion liner 104. This facilitates a portion of the air stream passing above and below the annular fuel nozzle 304 such that the fuel 126 is injected within the air stream to reduce or eliminate boundary layers of the air stream from containing fuel.

The annular fuel nozzle 304 is held in place by a plurality of support struts 326 and the plurality of fuel supply struts 308. In the example embodiment, the halo ring fuel injector 112 includes six (6) each of the support struts 326 and the fuel supply struts 308, equi-spaced about the central axis "B." Further, each support strut 326 is downstream from and generally axially aligned with a respective fuel supply strut 308. It is contemplated, however, that the halo ring fuel injector 112 may include fewer or more support struts 326 and/or fuel supply struts 308, and the general alignment of each may be any desired alignment that enables the halo ring fuel injector 112 to function as described herein.

In the exemplary embodiment, each of the support struts 326 and the fuel supply struts 308 extend inward and downstream from the downstream wall 318 to the annular fuel nozzle 304 at an angle relative to the central axis "B" in the range between and including about thirty-five degrees (35°) and about fifty-five degrees (55°). More particularly, each of the support struts 326 and the fuel supply struts 308 extend inward and downstream at an angle of about forty-five degrees (45°). In the example embodiment, each of the support struts 326 and the fuel supply struts 308 are substantially circular in section. It is contemplated, however, the sectional shape of the support struts 326 and the fuel supply struts 308 may be any shape that enables the halo ring fuel injector 112 to function as described herein. For example, in some embodiments, the support struts 326 and the fuel supply struts 308 may have an airfoil shape, elliptical shape, etc.

In the exemplary embodiment, each of the fuel supply struts 308 is substantially hollow. Furthermore, the annular fuel nozzle 304 is substantially hollow. The fuel supply struts 308 are coupled in fluid communication to the common annular manifold 310 and the annular fuel nozzle 304 to facilitate channeling a fuel therebetween, such as the fuel 126 (shown in FIG. 2).

Figure 4:
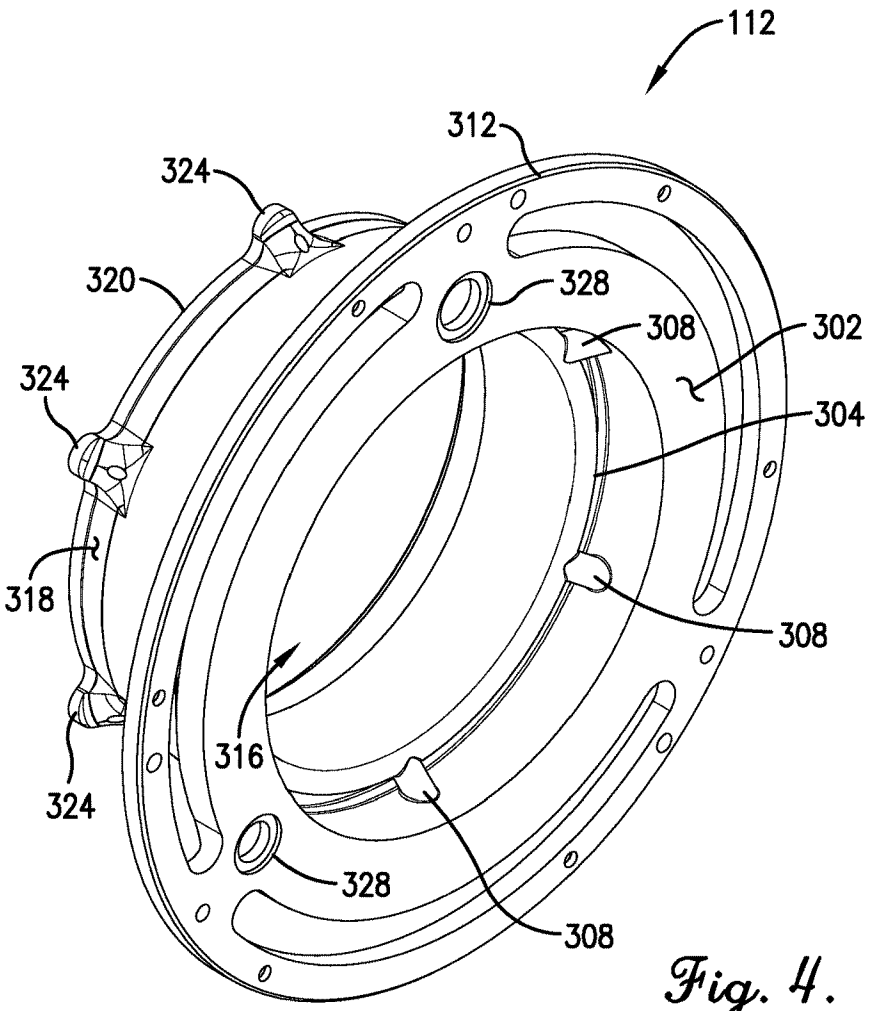
FIG. 4 is rear perspective of the embodiment of the halo ring fuel injector shown in FIG. 3.

Referring to FIG. 4, the upstream flange 312 of the body 302 includes one or more fuel supply ports 328. Each fuel supply port 328 is configured to be coupled to a fuel supply source of the gas turbine engine to receive fuel therefrom, such as the fuel 126. In the exemplary embodiment, the fuel supply ports 328 are positioned on an axial end of the upstream flange 312 to receive fuel axially. In certain embodiments, the fuel supply ports 328 may be sized and shaped to receive fuel in a radial direction. As a fuel enters through the fuel supply port 328, it flows into the annular manifold 310. The fuel, such as the fuel 126, flows from the annular manifold 310 into the fuel supply struts 308. The fuel the flows from the fuel supply struts 308 into the annular fuel nozzle 304, where it is injected into the air stream via the fuel injection ports 306.

Figure 7:
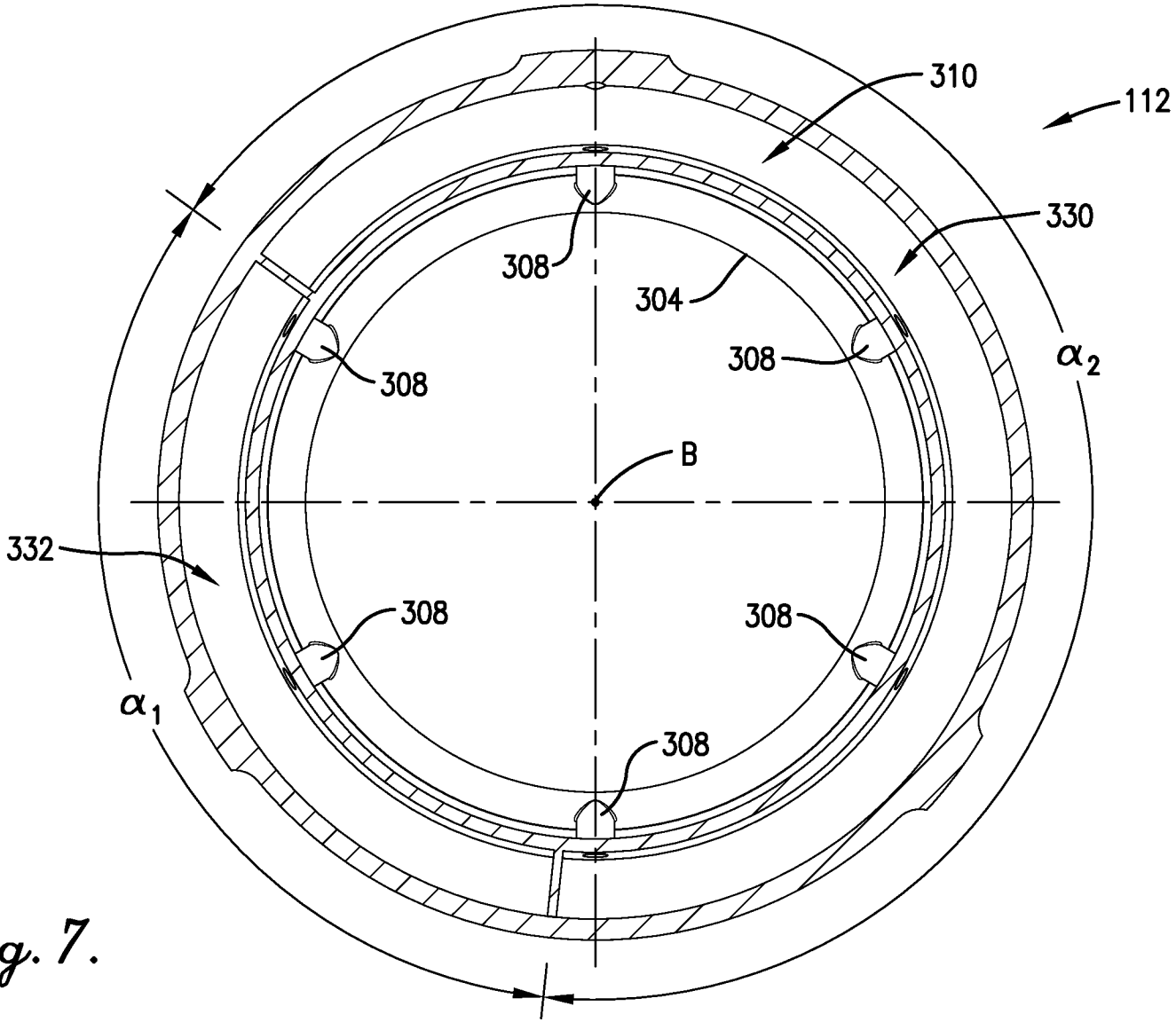
FIG. 7 is a rear view of the embodiment of the halo ring fuel injector, taken in vertical section along line 7-7 in FIG. 6 in the direction of the arrows.

As depicted in FIG. 7, the annular manifold 310 is divided into two separate sections 330 and 332. The first section 332 extends at an angle $\alpha_1$ of approximately one hundred and twenty degrees (120°) about the central axis "B" of the halo ring fuel injector 112. The second section 330 extends the remaining annular portion, or at an angle $\alpha_2$ of approximately two hundred and forty degrees (240°) about the central axis "B" of the halo ring fuel injector 112. The first section 332 of the halo ring fuel injector 112 is used to generate a Main 1 flame, while the second section 330 of the halo ring fuel injector 112 is used to generate a Main 2 flame. Each of the first and second sections 330 and 332 includes a respective one of the fuel supply ports 328.

The annular fuel nozzle 304 is shown in FIG. 8 as being of a generally airfoil-shape in section, wherein the airfoil shape is substantially constant about the annular fuel nozzle 304. In particular, in the example embodiment, the annular fuel nozzle 304 is a symmetrical airfoil. A symmetrical airfoil has substantially identical upper and lower surfaces about a chord line. A leading edge 334 is located upstream, proximate the upstream flange 312. A trailing edge 336 is located downstream of the leading edge 334, proximate the downstream rim 320 of the body 302. The annular fuel nozzle 304 is generally hollow, defining a cavity 340 therein. The trailing edge 336 of the annular fuel nozzle 304 has a channel 338 defined therein. The plurality of fuel injection ports 306 extend from the cavity 340 to the channel 338. The channel is configured to facilitate mixing of the fuel flowing through the fuel injection ports 306 such that a generally continuous curtain of fuel is injected into the air stream, rather than a plurality of individual jets of fuel.

Figure 9:
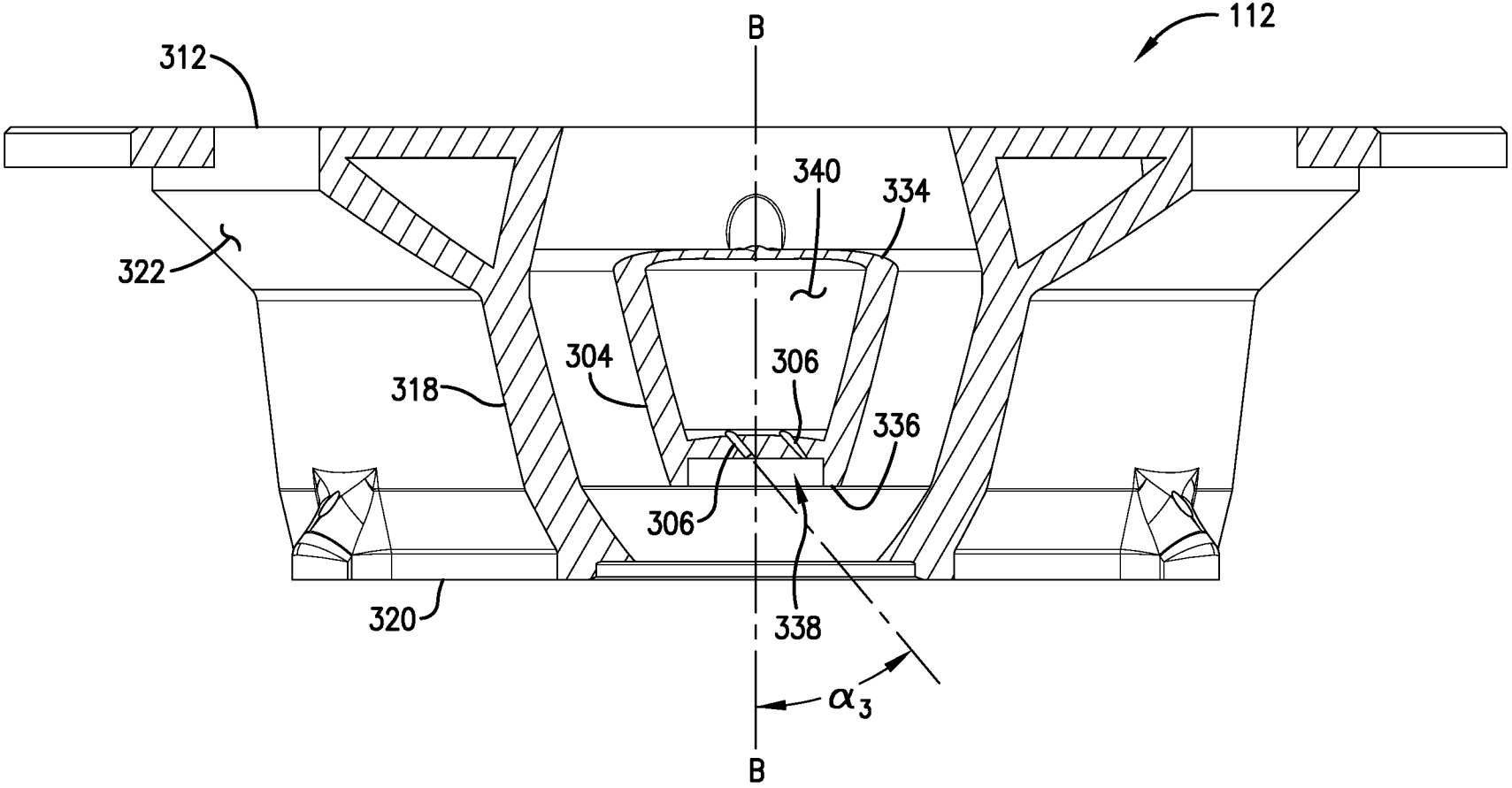
FIG. 9 is a top view of the embodiment of the halo ring fuel injector, taken in horizontal section along line 9-9 in FIG. 6 in the direction of the arrows and depicting angular injection ports for injecting fuel.
Figure 11:
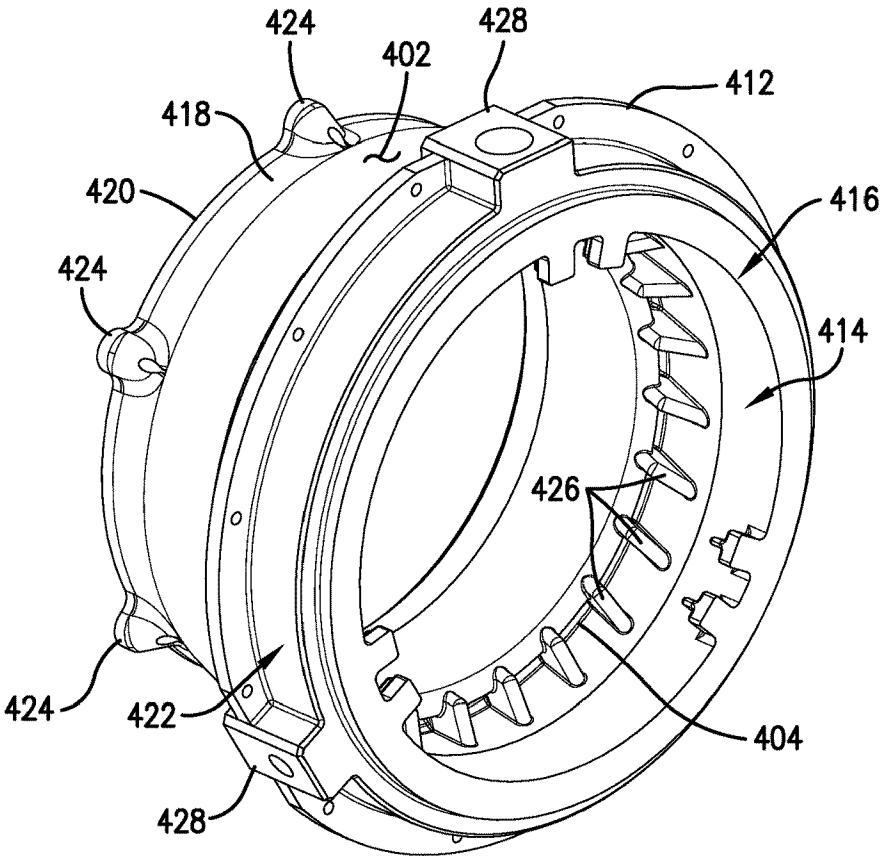
FIG. 11 is rear perspective of the embodiment of the halo ring fuel injector shown in FIG. 10.
Figure 10:
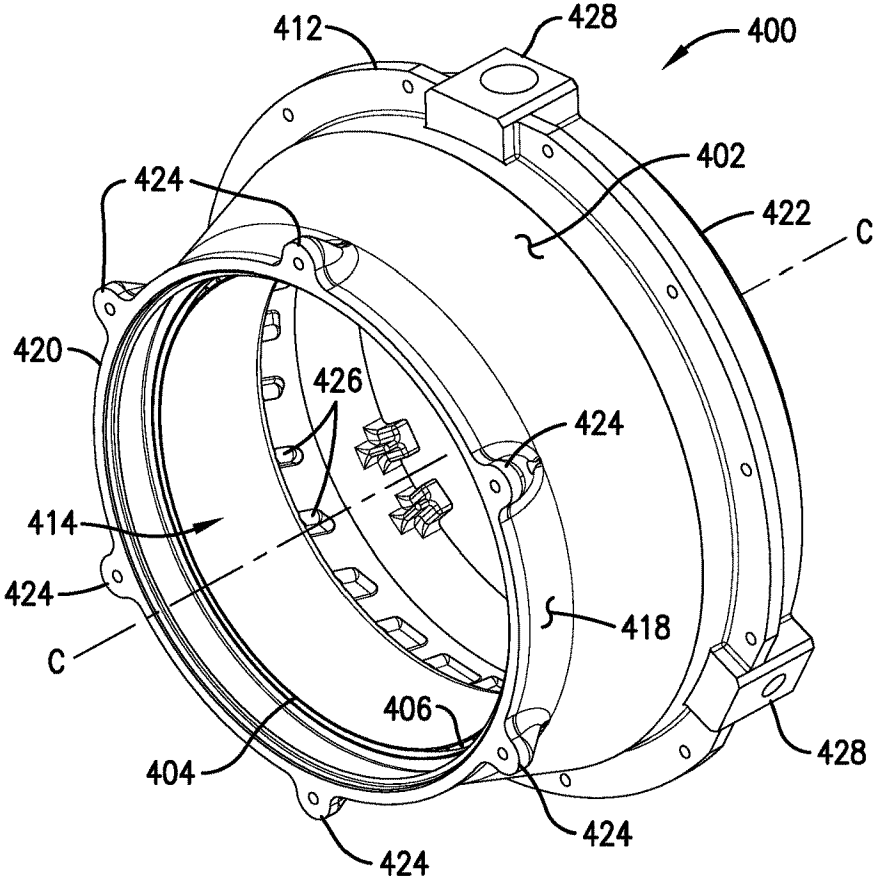
FIG. 10 is front perspective of a halo ring fuel injector of the combustor shown in FIG. 1, in accordance with another embodiment of the present invention.

Referring to FIG. 9, the plurality of fuel injection ports 306 extend substantially axially along the central axis "B." Further, while it is conceived that the plurality of fuel injection ports 306 are oriented parallel to the central axis "B," in the depicted example, the plurality of fuel injection ports 306 are formed at an angle relative to the central axis "B." This facilitates mixing of the fuel, such as the fuel 126, with the air stream by inducing a swirl into the injected fuel flow. In the example embodiment, the plurality of fuel injection ports 306 are formed relative to the central axis "B" an angle $\alpha 3$ in the range between and including about fifteen degrees (15°) and about fifty degrees (50°). More particularly, in an embodiment, the fuel injection ports 306 are formed at an angle of about forty degrees (40°).

Referring back to FIG. 2, it is noted that the cylindrical downstream wall 318 is generally arced between the upstream flange 312 and the downstream rim 320 of the body 302 to account for the volume of the nozzle 304. Positioning the annular fuel nozzle 304 of the halo ring fuel injector 112 in the air stream flowing to the combustor 100 causes a restriction in the air flow. The volume of the annular fuel nozzle 304 would reduce an amount of air entering the inlet end 106 of the combustion liner 104 if the downstream wall 318 were not shaped to account for the annular fuel nozzle 304. Consequently, the downstream wall 318 is shaped and sized to allow substantially a same amount of air to pass through the halo ring fuel injector 112 as is passed through an injector of a prior art gas turbine engine (not shown). An amount of arc and/or a shape of the downstream wall 318 is determined based in part on the size and shape of the annular fuel nozzle 304 and an air flow requirement of the gas turbine engine.

FIGS. 10-14 depict various detail views of another embodiment of a halo ring fuel injector assembly 400, which may be used in a gas turbine engine combustor, such as the combustor 100 (shown in FIG. 1). In some implementations, the halo ring fuel injector 400 is a unitary component that may be manufactured using various techniques, including, without limitation, additive manufacturing. In one embodiment, the halo ring fuel injector 400 may be fabricated using a DMLM process. The geometries of the halo ring fuel injector 400 are difficult to form using conventional casting technologies, thus fabrication of the halo ring fuel injector 400 using a DMLM process or an electron-beam melting process may be advantageous, for example, in the exemplary embodiment. It is contemplated, however, that any manufacturing process that enables the halo ring fuel injector 400 to be fabricated as described herein, may be used. Further, it is noted that the halo ring fuel injector 400 may require post-processing to provide desired structural characteristics.

In the exemplary embodiment, the halo ring fuel injector 400 is formed generally symmetrically about a central axis "C." The halo ring fuel injector 400 includes a generally cylindrical body 402. The body 402 is formed in a generally frustoconical shape, having a hollow interior space 414 defined therein. An upstream flange 412 of the body 402 is proximate an upstream opening 416 to the interior space 414. A cylindrical downstream wall 418 extends generally axially downstream from the upstream flange 412 towards a downstream rim 420 of the body 402. The downstream wall 418 generally tapers from a portion of the upstream flange 412 downstream at an inward angle to the downstream rim 420 of the body 402. An upstream wall 422 extends upstream from the upstream flange 412 and defines the upstream opening 416. A chamber defining an annular fluid manifold 410 is generally defined between the upstream flange 412, downstream wall 418, and the upstream wall 422. Proximate the downstream rim 420, the body 402 includes a plurality of mounting tabs 424.

Similar to the halo ring fuel injector 112 described above, the example halo ring fuel injector 400 includes an annular fuel nozzle 404. The annular fuel nozzle 404 is spaced inward of the downstream wall 418 a predefined distance. As noted, the annular fuel nozzle 404 is substantially similar to the annular fuel nozzle 304 described above. Accordingly, in a same manner as depicted in FIG. 2, the annular fuel nozzle 404 is generally positioned in the air stream such that it is spaced from the combustion liner 104. This facilitates a portion of the air stream passing above and below the annular fuel nozzle 404 such that fuel, such as the fuel 126, is injected within the air stream to reduce or eliminate boundary layers of the air stream from containing fuel.

The annular fuel nozzle 404 is held in place by a plurality of fuel supply struts 426. In the example embodiment, the halo ring fuel injector 400 includes twenty-four (24) fuel supply struts 426, equi-spaced about the central axis "C." Each of the fuel supply struts 426 extend inward and downstream from the downstream wall 418 to the annular fuel nozzle 404 at an angle relative to the central axis "C" in the range between and including about thirty-five degrees (35°) and about fifty-five degrees (55°). More particularly, each of the fuel supply struts 426 extend inward and downstream at an angle of about forty-five degrees (45°).

Figure 12:
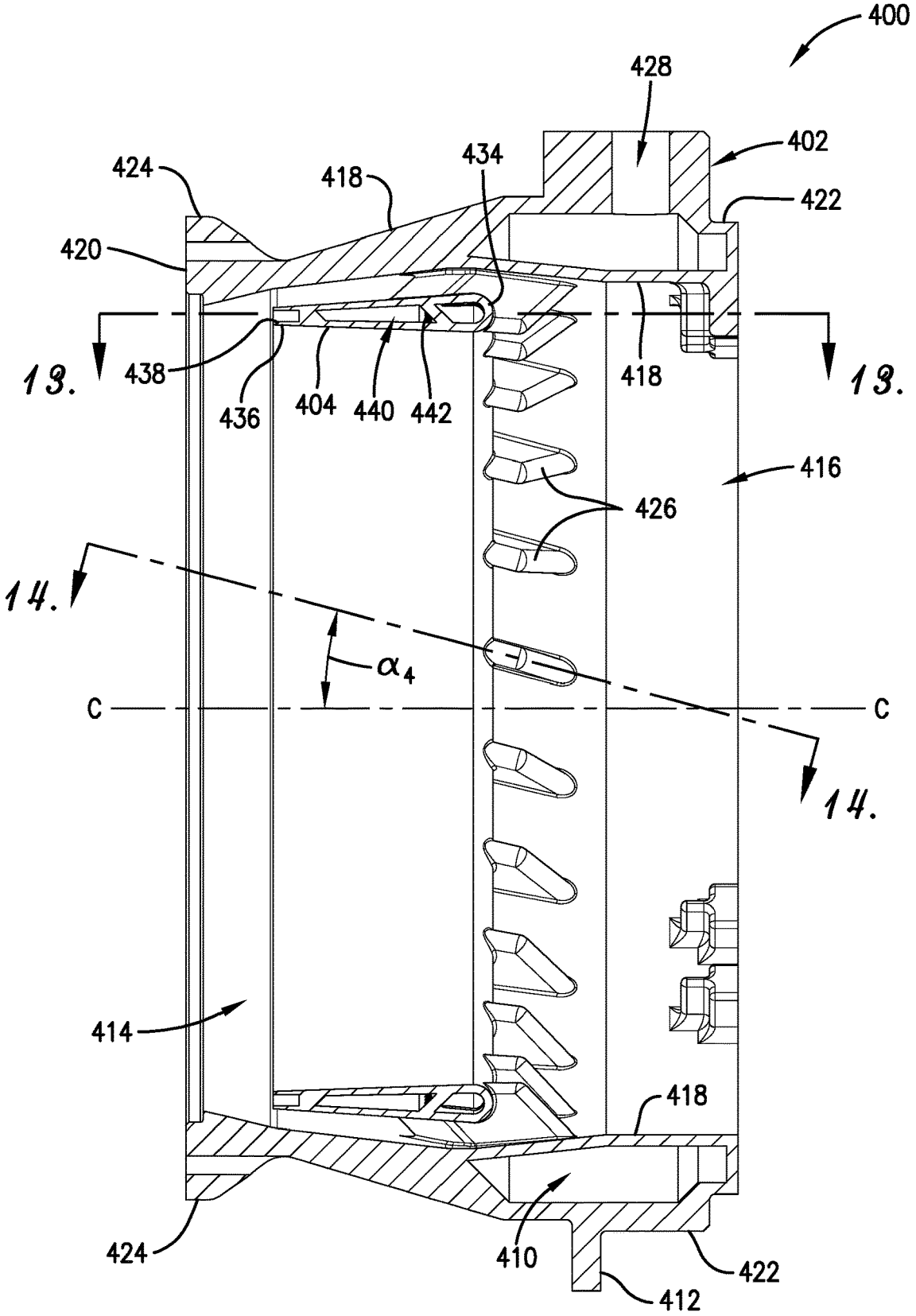
FIG. 12 is a side sectional view of the embodiment of the halo ring fuel injector shown in FIGS. 10 and 11.
Figure 13:
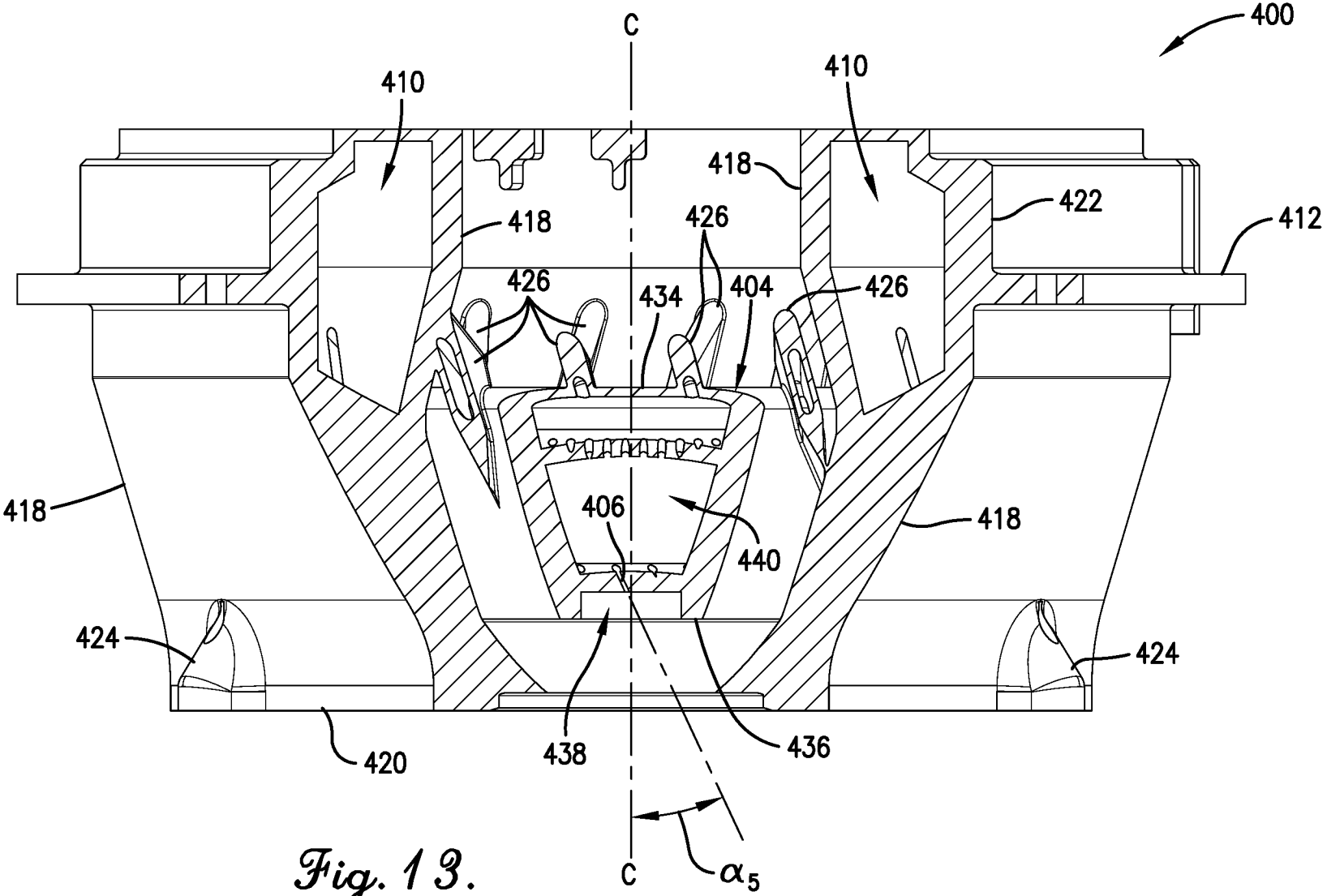
FIG. 13 is a top view of the embodiment of the halo ring fuel injector of FIGS. 10-12, taken in horizontal section along line 13-13 in FIG. 12 in the direction of the arrows and depicting angular injection ports for injecting fuel and angular fuel supply struts for inducing swirl.

In the exemplary embodiment, each of the fuel supply struts 426 is substantially airfoil-shaped in section (see FIG. 13). It is contemplated, however, that the sectional shape of the fuel supply struts 426 may be any shape that enables the halo ring fuel injector 400 to function as described herein. As depicted in FIG. 12, each of the fuel supply struts 426 is positioned at an angle $\alpha 4$ relative to the to the central axis "C." In particular, the airfoil shape is substantially symmetrical, and a chord of the airfoil shape is positioned at the angle $\alpha_4$. Although it is conceived that the fuel supply struts 426 can be configured at any angle between zero degrees (0°) and forty-five degrees (45°), in the depicted example, the angle $\alpha_4$ is in a range between and including about ten degrees (10°) and about twenty degrees (20°). More particularly, each of the fuel supply struts 426 is positioned at an angle of about fifteen degrees (15°). The angle $\alpha_4$ facilitates inducing a swirl into the air stream passing between the annular fuel nozzle 404 and the downstream wall 418. It is contemplated that the halo ring fuel injector 400 may include fewer or more fuel supply struts 426, and the general alignment of each may be any desired alignment that enables the halo ring fuel injector 400 to function as described herein.

In the exemplary embodiment, each of the fuel supply struts 426 is substantially hollow. Furthermore, the annular fuel nozzle 404 is substantially hollow. The fuel supply struts 426 are coupled in fluid communication to the annular manifold 410 and the annular fuel nozzle 404 to facilitate channeling a fuel therebetween, such as the fuel 126 (shown in FIG. 2).

Referring to FIG. 12, the upstream flange 412 of the body 402 includes one or more fuel supply ports 428. Each fuel supply port 428 is configured to be coupled to a fuel supply source of the gas turbine engine to receive fuel therefrom, such as the fuel 126. In the exemplary embodiment, the fuel supply ports 428 are positioned on a radial surface of the upstream flange 412 to receive fuel from a radial direction. As a fuel enters through the fuel supply port 428, it flows into the annular manifold 410. The fuel, such as the fuel 126, flows from the annular manifold 410 into the fuel supply struts 426. The fuel then flows from the fuel supply struts 426 into the annular fuel nozzle 404, where it is injected into the air stream via a plurality of fuel injection ports 406.

In the example embodiment, the annular manifold 410 is divided into two sections, wherein a first section extends at an angle of approximately one hundred and twenty degrees (120°) about the central axis "C," and the second section extends the remaining annular portion, or at an angle of approximately two hundred and forty degrees (240°) about the central axis "C." The first section of the halo ring fuel injector 400 is used to generate a Main 1 flame, while the second section of the halo ring fuel injector 400 is used to generate a Main 2 flame.

As depicted in FIG. 12, the annular fuel nozzle 404 is generally airfoil-shaped in section. In particular, in the example embodiment, the annular fuel nozzle 404 is a symmetrical airfoil. A leading edge 434 is located upstream, proximate the upstream flange 412. A trailing edge 436 is located downstream of the leading edge 434, proximate the downstream rim 420 of the body 402. The trailing edge 436 of the annular fuel nozzle 404 has a channel 438 defined therein.

Figure 14:
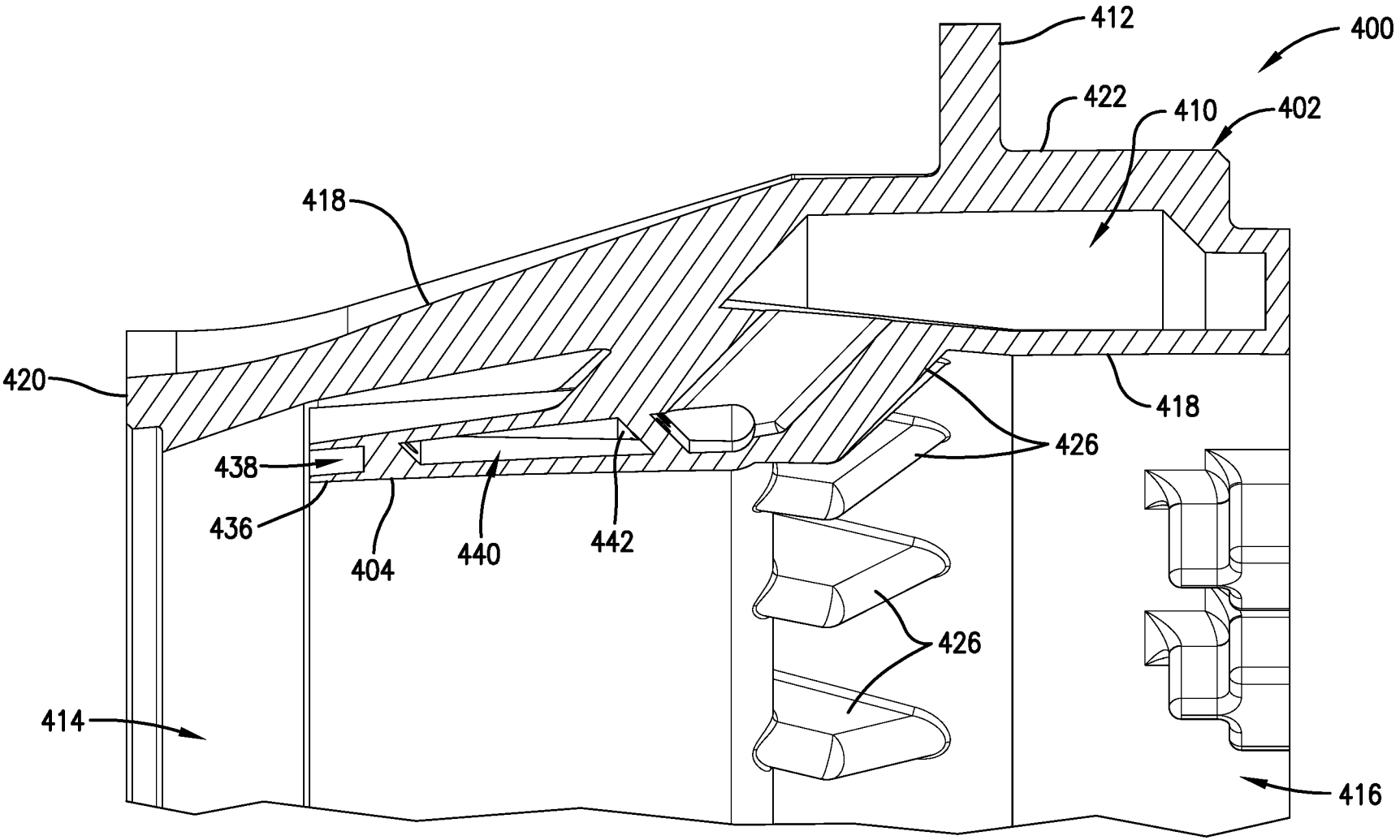
FIG. 14 is a partial side view of the embodiment of the halo ring fuel injector shown in FIGS. 10-13, taken in section along line 14-14 in FIG. 12 in the direction of the arrows and depicting an airfoil-shaped nozzle.

In the example embodiment, the annular fuel nozzle 404 is generally hollow, defining a cavity 440 therein. Referring to FIG. 14, the nozzle includes a perforated wall 442 positioned in the cavity 440. The perforated wall 442 divides the cavity into two (2) portions and facilitates an even distribution of the fuel, such as the fuel 126, to the fuel injection ports 406. In particular, a first portion is in direct fluid communication with the plurality of fuel supply struts 426, and a second portion is in direct fluid communication with the plurality of fuel injection ports 406. The first and second portions are in fluid communication with each other via a plurality of perforations defined in the perforated wall 442.

As depicted in FIG. 13, in the exemplary embodiment, the plurality of fuel injection ports 406 extend from the cavity 440 to the channel 438. The channel is configured to facilitate mixing of the fuel flowing through the fuel injection ports 406 such that a generally continuous curtain of fuel is injected into the air stream, rather than a plurality of individual jets of fuel. While it is conceived that the plurality of fuel injection ports 406 are oriented parallel to the central axis "C," in the depicted example, the plurality of fuel injection ports 406 are angled relative to the central axis "C." The angle facilitates mixing of the fuel, such as the fuel 126, with the air stream by inducing a swirl into the injected fuel flow. In the example embodiment, the plurality of fuel injection ports 406 are formed relative to the central axis "C" at an angle as in the range between and including about fifteen degrees (15°) and about fifty degrees (50°). More particularly, in an embodiment, the fuel injection ports 406 are formed at an angle of about forty degrees (40°).

The cylindrical downstream wall 418 is generally arced between the upstream opening 416 and the downstream rim 420 of the body 402. As described above with respect to the nozzle 304 of the halo ring fuel injector 112, positioning the annular fuel nozzle 404 of the halo ring fuel injector 400 in the air stream flowing to the combustor 100 causes a restriction in the air flow. The volume of the annular fuel nozzle 404 would reduce an amount of air entering the inlet end 106 of the combustion liner 104 if the downstream wall 418 were not shaped to account for the annular fuel nozzle 404. Consequently, the downstream wall 418 is shaped and sized to allow substantially a same amount of air to pass through the halo ring fuel injector 400 as is passed through an injector of a prior art gas turbine engine (not shown). An amount of arc and/or a shape of the downstream wall 418 is determined based in part on the size and shape of the annular fuel nozzle 404 and an air flow requirement of the gas turbine engine.

As described above, each of the fuel supply struts 426 is positioned at an angle of about fifteen degrees (15°) and the fuel injection ports 406 are formed at an angle of about forty degrees (40°). Similar to what is shown in FIG. 2, air passing between the combustion liner 104 and the annular fuel nozzle 404 may pass substantially straight through the halo ring fuel injector 400. Air passing between the downstream wall 418 and the annular fuel nozzle 404 will be deflected by the fuel supply struts 426 at an angle of about fifteen degrees (15°), thereby inducing a swirl to this portion of the air flow. In addition, at the trailing edge 436 of the nozzle, a stream of fuel is injected into the air flow at an angle of about forty degrees (40°). This results in additional turbulence, further promoting thorough mixing of the fuel and air, thereby supporting low NOx and CO emissions when burning the air/fuel mixture in the combustor.

Advantages of the fuel injection systems described above include reducing or eliminating fuel in boundary layers of the air stream passing through the combustor. Boundary layers are low velocity flow regions adjacent to geometric features. The disclosed halo ring fuel injectors include a nozzle that "floats" within the free stream of the premixing fuel channel ensuring that boundary layers entering the combustion chamber are free of fuel. Fuel in the boundary layers can result in flashback. Further, the nozzle injects the fuel at an angle relative to the air stream to facilitate good mixing of the fuel and air, which is key to reduced or low NOx and CO emissions.

ADDITIONAL CONSIDERATIONS

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Although the present application sets forth a detailed description of numerous different embodiments, it should be understood that the legal scope of the description is defined by the words of the claims and equivalent language. The detailed description is to be construed as exemplary only and does not describe every possible embodiment because describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order recited or illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein. The foregoing statements in this paragraph shall apply unless so stated in the description and/or except as will be readily apparent to those skilled in the art from the description.

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

Although the disclosure has been described with reference to the embodiments illustrated in the attached figures, it is noted that equivalents may be employed, and substitutions made herein, without departing from the scope of the disclosure as recited in the claims.

Having thus described various embodiments of the disclosure, what is claimed as new and desired to be protected by Letters Patent includes the following:

1. A combustor comprising:

a cylindrical combustion liner having an inlet end, an outlet end, and a central axis, the combustion liner defining a combustion chamber; and a fuel injector assembly positioned radially outward of the cylindrical combustion liner relative to the central axis, the fuel injector assembly comprising:

an annular body defining:

a hollow interior space;

first and second openings to the interior space, wherein the first and second openings are respectively proximate opposite first and second ends of the annular body, the first end being upstream of the second end;

an upstream flange defining the first opening; and a chamber defining a fluid manifold;

an annular fuel nozzle defining a cavity therein and positioned in the interior space and spaced from the annular body and the cylindrical combustion liner, the annular fuel nozzle being airfoil shaped in section and comprising a leading edge proximate the first end, a trailing edge proximate the second end of the annular body, and a plurality of fuel injection ports, wherein said trailing edge comprising a channel defined therein and said plurality of fuel injection ports extend from the cavity to the channel; and one or more fuel supply struts coupled to the annular fuel nozzle and the annular body, wherein the one or more fuel supply struts are coupled in fluid communication with the fluid manifold and the annular fuel nozzle.

2. The combustor in accordance with claim 1, said annular body of the fuel injector assembly comprising:

a cylindrical downstream wall that extends generally axially downstream from the upstream flange and defining a downstream rim of the annular body, the downstream rim defining the second opening.

3. The combustor in accordance with claim 2, said cylindrical downstream wall being arced between the upstream flange and the downstream rim to account for a volume of the annular fuel nozzle.

4. The combustor in accordance with claim 1, said annular body defining a central axis, each of said plurality of fuel injection ports being formed, relative to the central axis, at an angle in the range between and including about fifteen degrees (15°) and about fifty degrees (50°).

5. A fuel injector assembly comprising:

an annular body defining:

a hollow interior space;

first and second openings to the interior space, wherein the first and second openings are respectively proximate opposite first and second ends of the annular body, the first end being upstream of the second end; and a chamber defining a fluid manifold;

an annular fuel nozzle positioned in the interior space and spaced from the annular body, the annular fuel nozzle comprising a plurality of fuel injection ports and a leading edge proximate the first end and a trailing edge proximate the second end of the annular body, wherein the annular fuel nozzle is airfoil shaped in section and defines a cavity therein, the trailing edge comprises a channel defined therein, and said plurality of fuel injection ports extend from the cavity to the channel; and one or more fuel supply struts coupled to the annular fuel nozzle and the annular body, wherein the one or more fuel supply struts are coupled in fluid communication with the fluid manifold and the annular fuel nozzle.

6. The fuel injector assembly in accordance with claim 5, said annular body defining a central axis, each of said plurality of fuel injection ports being formed, relative to the central axis, at an angle in the range between and including about fifteen degrees (15°) and about fifty degrees (50°).

7. The fuel injector assembly in accordance with claim 5, said annular fuel nozzle comprising a perforated wall positioned in the cavity, said perforated wall dividing the cavity into a first portion in direct fluid communication with the plurality of fuel supply struts, and a second portion in direct fluid communication with the plurality of fuel injection ports.

8. A fuel injector assembly comprising:

an annular body defining:

a central axis;

a hollow interior space;

first and second openings to the interior space, wherein the first and second openings are respectively proximate opposite first and second ends of the annular body, the first end being upstream of the second end;

an upstream flange defining the first opening; and a chamber defining a fluid manifold;

an annular fuel nozzle positioned in the interior space and spaced from the annular body, the annular fuel nozzle comprising a plurality of fuel injection ports, each of said plurality of fuel injection ports being formed, relative to the central axis, at an angle in the range between and including about fifteen degrees (15°) and about fifty degrees (50°); and one or more fuel supply struts coupled to the annular fuel nozzle and the annular body, wherein the one or more fuel supply struts are coupled in fluid communication with the fluid manifold and the annular fuel nozzle.

9. A fuel injector assembly comprising:

an annular body defining:

a central axis;

a hollow interior space;

first and second openings to the interior space, wherein the first and second openings are respectively proximate opposite first and second ends of the annular body, the first end being upstream of the second end;

an upstream flange defining the first opening; and a chamber defining a fluid manifold, wherein said fluid manifold is divided into a first section and a separate second section, the first section extending, relative to the central axis, at an angle of approximately one hundred and twenty degrees (120°), the second section extending, relative to the central axis, at an angle of approximately two hundred and forty degrees (240°), said first section comprising a first fuel supply port configured to receive a fuel therethrough, and said second section comprising a second fuel supply port configured to receive a fuel therethrough;

an annular fuel nozzle positioned in the interior space and spaced from the annular body, the annular fuel nozzle comprising a plurality of fuel injection ports; and one or more fuel supply struts coupled to the annular fuel nozzle and the annular body, wherein the one or more fuel supply struts are coupled in fluid communication with the fluid manifold and the annular fuel nozzle.

10. A fuel injector assembly comprising:

an annular body defining:

a hollow interior space;

first and second openings to the interior space, wherein the first and second openings are respectively proximate opposite first and second ends of the annular body, the first end being upstream of the second end;

an upstream flange defining the first opening; and a chamber defining a fluid manifold;

an annular fuel nozzle positioned in the interior space and spaced from the annular body, the annular fuel nozzle comprising a plurality of fuel injection ports;

one or more fuel supply struts coupled to the annular fuel nozzle and the annular body, wherein the one or more fuel supply struts are coupled in fluid communication with the fluid manifold and the annular fuel nozzle; and one or more support struts coupled to the annular fuel nozzle and the annular body, each of said one or more support struts being positioned downstream from a respective one of the one or more fuel supply struts, and each of said one or more support struts being axially aligned with the respective one of the one or more fuel supply struts.

11. A fuel injector assembly comprising:

an annular body defining:

defining a central axis;

a hollow interior space;

first and second openings to the interior space, wherein the first and second openings are respectively proximate opposite first and second ends of the annular body, the first end being upstream of the second end;

an upstream flange defining the first opening; and a chamber defining a fluid manifold;

an annular fuel nozzle positioned in the interior space and spaced from the annular body, the annular fuel nozzle comprising a plurality of fuel injection ports; and one or more fuel supply struts being airfoil shaped in section and coupled to the annular fuel nozzle and the annular body, wherein the one or more fuel supply struts are coupled in fluid communication with the fluid manifold and the annular fuel nozzle, wherein a chord of each of said one or more fuel supply struts is positioned, relative to the central axis, at an angle in a range between and including about ten degrees (10°) and about twenty degrees (20°).

12. The fuel injector assembly in accordance with claim 11, each of said plurality of fuel injection ports being formed, relative to the central axis, at an angle in the range between and including about fifteen degrees (15°) and about fifty degrees (50°) in the same direction as the one or more fuel supply struts.

* * * * *